US005851716A

United States Patent [19]

Kuramoto et al.

[11] Patent Number: 5,851,716

[45] Date of Patent: Dec. 22, 1998

[54] ELECTROPHOTOGRAPHIC IMAGE FORMING METHOD AND TONER COMPOSITION USED THEREFOR

[75] Inventors: Shinichi Kuramoto; Masami Tomita; Hiroyuki Fushimi, all of Numazu, Japan

[73] Assignee: Ricoh Company, Ltd., Tokyo, Japan

[21] Appl. No.: 835,522

[22] Filed: Apr. 8, 1997

[30] Foreign Application Priority Data

| | | | |
|---|---|---|---|
| Apr. 8, 1996 | [JP] | Japan | 8-110555 |
| Apr. 15, 1996 | [JP] | Japan | 8-115293 |
| May 24, 1996 | [JP] | Japan | 8-152992 |
| Jun. 18, 1996 | [JP] | Japan | 8-177546 |
| Jun. 18, 1996 | [JP] | Japan | 8-177548 |

[51] Int. Cl.[6] ..... G03G 9/097; G03G 13/16

[52] U.S. Cl. ..... 433/110; 430/111; 430/126

[58] Field of Search ..... 430/110, 126, 430/111

[56] References Cited

U.S. PATENT DOCUMENTS

| | | | |
|---|---|---|---|
| 4,623,605 | 11/1986 | Kato et al. | 430/110 |
| 4,943,507 | 7/1990 | Takahashi et al. | 430/120 |
| 5,139,916 | 8/1992 | Ciccarelli | 430/137 |
| 5,194,356 | 3/1993 | Sacripante et al. | 430/110 |
| 5,266,432 | 11/1993 | Hayashi et al. | 430/109 |
| 5,409,989 | 4/1995 | Ito et al. | 430/120 |

*Primary Examiner*—Roland Martin
*Attorney, Agent, or Firm*—Oblon, Spivak, McClelland, Maier & Neustadt, P.C.

[57] ABSTRACT

An image forming method wherein a toner image on an image carrier is transferred to an intermediate image transfer element, the transferred toner image on said intermediate image transfer element being subsequently transferred to a transfer medium, and wherein the toner exhibits an electric potential change ΔVp of less than 150 V as an absolute value in the charge penetration test defined in the Specification.

9 Claims, 1 Drawing Sheet

ELECTROPHOTOGRAPHIC IMAGE FORMING METHOD AND TONER COMPOSITION USED THEREFOR

BACKGROUND OF THE INVENTION

This invention relates generally to an electrophotographic image forming method used in, for example, copiers, printers or facsimile machines and, more specifically, to an image forming method wherein a toner image on an image carrier is transferred in a first transfer step to an intermediate image transfer element, the transferred toner image on the intermediate image transfer element being subsequently transferred in a second transfer step to a transfer medium such as paper. The present invention is also directed to a toner composition suitable for the above image forming method.

The image forming method using an intermediate image transfer element is now adopted in a full-color copying machine wherein separated color images from an original image are reproduced by successively transferring cyan, magenta, yellow and black toner images on a transfer medium.

The image forming method using an intermediate image transfer element suffers from a drawback that a toner image is expanded or dispersed during the image transfer step so that the reproduced image becomes dull. Especially, conventional image forming method encounters a difficulty in obtaining sharp fine lines. Further, with known image forming method, it is difficult to obtain a clear image free of local omission (so called "worm-eaten" portions) of toner images important because of insufficient efficiency of the transference of toner images from the image carrier to the intermediate image transfer element (first transfer step and/or from the intermediate image transfer element to the transfer medium (second transfer step).

SUMMARY OF THE INVENTION

In accordance with the present invention there is provided an image forming method wherein a toner image on an image carrier is transferred to an intermediate image transfer element, the transferred toner image on said intermediate image transfer element being subsequently transferred to a transfer medium, and wherein said toner exhibits an electric potential change ΔVp of less than 150 V as an absolute value in the charge penetration test defined hereinbelow.

In another aspect, the present invention provides a toner composition for developing an electrostatic image, which exhibits an electric potential change ΔVp of less than 150 V as an absolute value in the charge penetration.

In the present specification and appended claims, "electric potential change ΔVp" and "static charging ΔVs" are as measured by the following charge penetration test and frictional charging test.

Charge Penetration Test:

Sample toner is applied onto an aluminum plate with a cascade developing device in an amount of 0.8 mg/cm$^2$ to obtain a toner layer. The aluminum plate, is grounded and the surface potential Vp1 of the toner layer is measured with a surface potentiometer. The aluminum plate is then disconnected from the ground and the toner layer is subjected to a corona discharge treatment using a Corotron charger for a charging time of 400 milliseconds with an impressed voltage of 5 KV and a charger height (a distance between the surface of the toner layer and the Corotron charger) of 20 mm. Immediately after the corona discharge treatment, the surface potential Vp2 of the toner layer is measured with the surface potentiometer. The electric potential change ΔVp is defined as follows:

$$\Delta Vp=|Vp1-Vp2|$$

Frictional Charging Test:

A surface layer having the same composition as that of the surface of a given image carrier (photosensitive medium) is formed on an aluminum plate. The aluminum plate is grounded and the surface potential Vs1 of the surface layer is measured with a. surface potentiometer. The aluminum plate is then disconnected from the ground and the surface layer is frubbed 20 times (20 reciprocations) with a toner layer. formed on an adhesive tape bonded to a clock meter. Thereafter, the surface potential Vs2 of the surface layer is measured with the surface potentiometer. The static charging ΔVs between the given image carrier (photosensitive medium) and the toner is defined as follows:

$$\Delta Vs=|Vs1-Vs2|.$$

In the above frictional charging test, the given image carrier itself can be used in lieu of the aluminum plate having the surface layer formed thereon. The charge penetration and frictional charging tests are carried out at a temperature of 20° C. and a relative humidity of 50%.

It is the prime object of the present invention to provide an image forming method using an intermediate image transfer element, which can give clear sharp toner images.

Another object of the present invention is to provide an image forming method of the above-mentioned type which can give toner images free of "worm-eaten" portions.

It is a further object of the present invention to provide a toner composition suitable for the above image forming method.

BRIEF DESCRIPTION OF THE DRAWINGS

Other objects, features and advantages of the present invention will become apparent from the detailed description of the preferred embodiments of the invention which follows, when considered in light of the accompanying drawing, in which.

DETAILED DESCRIPTION OF THE PREFERRED EMBODIMENTS OF THE INVENTION

Figure 1:
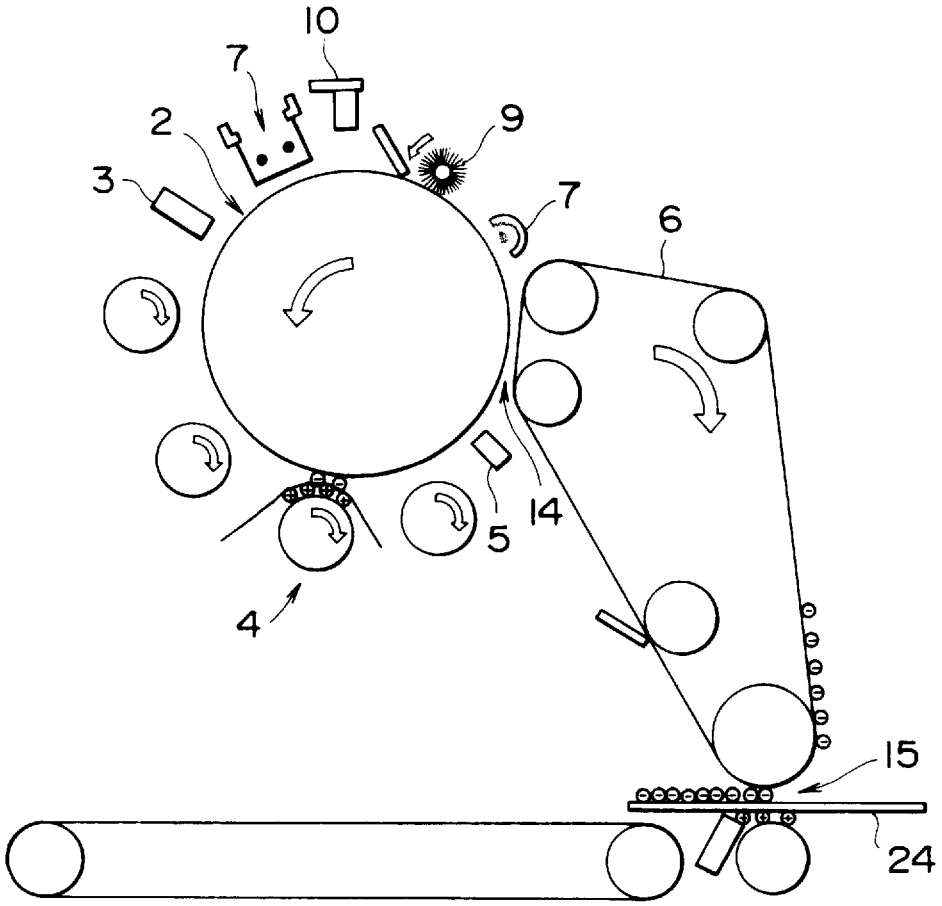
FIG. 1 is a vertical cross-sectional view diagrammatically showing the general construction of a color image forming apparatus suitable for carrying out the method of the present invention.

FIG. 1 depicts an image forming apparatus which is suitably used for carrying out the method according to the present invention and which is known per se. Designated as 13 is a drum or a charge carrier rotated about the axis thereof and adapted to carry a toner image thereon. Arranged around the circumference of the drum 13 are drum cleaning means 7 and 9, a discharge lamp 10, a charger 7, an exposing section 2, a potential sensor 3, a developing device 4 including four units for cyan, magenta, yellow and black colors, a sensor 5 and a primary image transfer section 14 where an intermediate image transfer element 6 in the form of an endless belt is in moving contact with the drum 13. The intermediate image transfer element 6 moves along a predetermined path including a secondary image transfer section 15 where an image transfer medium 24 such as paper is fed for contact with the image transfer element 6.

In operation, the drum 13 is electrified either positively or negatively by the charger 7 and imagewise exposed in the exposing section 2 to form a latent image. The latent image on the drum 13 is then developed by the developing device 4 to form a toner image with a first color such as cyan, which in turn is transferred in the primary transfer section 14 to the intermediate image transfer element 6. Similar operations are repeated for successively transferring toner images of different colors to the intermediate image transfer element 6, thereby obtaining a full color toner image thereon. The full color toner image on the element 6 is then transferred in the secondary image transfer section 15 to the image transfer medium 24 and is fixed in a fixing section (not shown) to obtain a full color copy.

In the above image-forming method, it is important that the toner used should exhibit an electric potential change ΔVp of less than 150 V, preferably, 100 V or less, as an absolute value in the charge penetration test defined hereinabove. Preferably, the toner used should also exhibit static charging ΔVs of less than 20 V as an absolute value in the frictional charging test defined hereinabove. Such a specific toner can be obtained by suitably selecting the kinds, amounts and combination of constituents of the toner such as a binder resin, a coloring agent, and other optional ingredients such as a charge controlling agent.

The binder resin may be, for example, a homopolymer of styrene or a styrene derivative such as polystyrene, poly(p-chlorostyrene) or poly(vinyltoluene); a styrene copolymer such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene terpolymer, a styrene-maleic acid copolymer or a styrene-maleate copolymer; poly(methyl methacrylate); poly(butyl methacrylate); poly(vinyl chloride); poly(vinyl acetate); polyethylene; polypropylene; polyester; polyurethane; polyamide; an epoxy resin; poly (vinyl butyral); poly(acrylic acid); rosin; modified rosin; a terpene resin; an aliphatic or alicyclic hydrocarbon resin; an aromatic petroleum resin; chlorinated paraffin; or paraffin wax. These resins may be used by themselves or as a mixture of two or more.

Any known colorant may be used for the purpose of the invention. The colorant may be, for example, carbon black, a nigrosine dye, iron black, Naphthol Yellow S, Hansa Yellow (10G, 5G, G, GR, A, RN and R), cadmium yellow, Chinese yellow, chrome yellow, yellow iron oxide, titanium yellow, Polyazo Yellow, Oil Yellow, Pigment Yellow L, Benzidine Yellow (G and GR), Permanent Yellow NCG, Vulcan Fast Yellow, Tartradine Lake, Quinoline Yellow Lake, Anthrazan Yellow BGL, Isoindolinone Yellow, red iron oxide, red lead, lead vermilion, cadmium red, cadmium mercury red, antimony vermilion, Permanent Red 4R, Para Red, Fisay Red, parachloro-orthonitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Lubin B, Brilliant Scarlet G, Lithol Lubin GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosin Lake, Rhodamine Lake B, Rhodamine Lake Y, Alizarine Lake, Thioindigo Red B, Thioindigo Maroon, Oil Red, Quinacridon Red, Pyrazolon Red, Polyazo Red, chrome vermilion, Benzidine Orange, Perinon Orange, Oil Orange, Cobalt Blue, Selulian Blue, Alkali Blue Lake, Peacock Blue Lake, Victoria Blue Lake, non-metal Phthalocyanine Blue, Phthalocyanine Blue, Fast Sky Blue, Indanthrene Blue (RS and BC), Indigo, Iron Blue, Ultramarine Blue, Anthraquinone Blue, Fast Violet B, Methyl Violet Lake, Cobalt Vilet, Manganese Violet, Dioxan Violet, Anthraquinone Violet, Chrome Green, Zinc Green, chromium oxide, Pylidian, Emerald Green, Pigment Green B, Naphthol Green B, Green Gold, Acid Green Lake, Marakite Green-Lake, Phthalocyanine Green, Antraquinone Green, titanium oxide, Chinease White or Lithopone. These colorants may be used by themselves or in combination with two or more. The colorant is generally used in an amount of 0.1–50 parts by weight per 100 parts by weight of the binder resin.

The charge controlling agent may be, for example, a nigrosin dye, a triphenylmethane dye, a chromium complex dye, a molybdate chelate pigment, a rhodamine dye, an alkoxy amine, a quaternary ammonium salt, a fluorinated quaternary ammoniumsalt, an alkylamide, phosphorus, a phosphorus compound, tungsten, a tungsten compound, a fluorine-containing surfactant, a metal salt of salicylic acid or a metal salt of a salicylic acid derivative. The amount of the charge controlling agent is determined according to the kind of the binder resin, the method of preparation of toner, etc., but is generally in the range of 0.1–10 parts by weight per 100 parts by weight of the binder resin.

The toner according to the present invention may contain one or more other additives, if desired. Illustrative of additives are a lubricant such as a fluorine-containing polymer (e.g. tetrafluoroethylene), a metal salt of a fatty acid (e.g. zinc stearate or aluminum stearate) or a metal oxide (e.g. aluminum oxide, tin oxide or antimony oxide); an abrasive such as cerium oxide or silicon carbide; and a fixation adjuvant such as a low molecular weight polyolefin.

The toner used in the present invention is in the form of fine particles having a volume average diameter of 1–30 μm, preferably 4–16 μm. The toner particles are preferably used in conjunction with hydrophobic silica. Especially good results may be obtained when the toner particles are used together with a mixture of hydrophobic silica particles with titanium particles. In this case, it is preferred that titanium oxide used in the present invention be hydrophobic for the prevention of the formation of "worm-eaten" portions and dull image.

Hydrophobic silica and hydrophobic titanium oxide may be prepared by treating silica and titanium oxide with a silane coupling agent such as methyltrimethoxysilane, methyltriethoxysilane or octyltrimethoxysilane. Examples of other suitable silane coupling agents include as follows: $CF_3(CH_2)_2SiCl_3$, $CH_3(CH_2)_5SiCl_3$, $CH_3(CH_2)_7SiCl_3$, $CH_3(CH_2)_7SiCl_3$, $CH_3(CH_2)_9SiCl_3$, $CH_3(CH_2)_9Si(CCH_3)_3$, $CH_3(CH_2)_9Si(CH_3)Cl_2$, $CH_3(CH_2)_2Si(OCH_3)_3$, $CH_3(CH_2)_2Si(CH_3)(OCH_3)_2$, $CH_3(CH_2)_5Si(OCH_3)_3$, $CH_3(CH_2)_5CONH(CH_2)_2Si(OC_2H_5)_3$, $CH_3(CH_2)_4COO(CH_2)_2Si(OCH_3)_3$, $CH_3(CH_2)_9Si(OCH_3)_3$, $CH_3(CH_2)_9Si(CH_3)(OCH_3)_2$, $CH_3(CH_2)_7SO_2NH(CH_2)_3Si(OC_2H_5)_3$, $CH_3(CH_2)_8(CH_2)_2Si(OCH_3)_3$, $CF_3(CF_2)_5SiCl_3$, $CF_3(CF_2)_5(CH_2)_2SiCl_3$, $CF_3(CF_2)_7(CH_2)_2SiCl_3$, $CF_3(CF_2)_7(CH_2)_2Si(OCH_3)_3$, $CF_3(CF_2)_7(CH_2)_2Si(CH_3)Cl_2$, $CF_3(CF_2)_2Si(OCH_3)_3$, $CF_3(CH_2)_2Si(CH_3)(OCH_3)_2$, $CF_3(CF_2)_3(CH_2)_2(CH_2)_2Si(OCH_3)_3$, $CF_3(CF_2)_5CONH(CH_2)_2Si(OC_2H_5)_3$, $CF_3(CF_2)_4COO(CH_2)_2Si(OCH_3)_3$, $CF_3(CF_2)_7(CH_2)_2Si(OCH_3)_3$, $CF_3(CF_2)_7(CH_2)_2Si(CH_3)(OCH_3)_2$, $CF_3(CF_2)_7SO_2NH(CH_2)_3Si(OC_2H_5)_3$, $CF_3(CF_2)_8(CH_2)_2Si(OCH_3)_3$.

Hydrophobic silica may be commercially available under trade names of HDK H2000, HDK H2000/4, HDK H2050EP, HVK21 (products of Hoechst Inc.), R972, R974, RX200, RY200, R202, R805 and R818 (products of Japan Aerosil Inc.). Titanium oxide may be commercially available under trade names of P-25 (product of Japan Aerosil Inc.), STT-30, Stt-65C-S (products of Titan Industry Co., Ltd.), TAF-140 (product of Fuji Titanium Industry Ltd.), MT-150W, MT-500B and MT-600B (products of Teika Inc.). Hydrophobic titanium oxide may also be commercially available under trade names of T-805 (product of Japan Aerosil Inc.), STT-30A, Stt-65S-S (products of Titan Industry Co., Ltd.), TAF-500T, TAF-1500T (product of Fuji Titanium Industry Ltd.), MT-100S, MT-100T (products of Teika Inc.) and IT-S (product of Ishihara Sangyo Co., Ltd.).

The hydrophobic silica and hydrophobic titanium oxide may also be obtained by treating silica and titanium oxide with a silicone oil, a higher fatty acid (e.g. lauric acid or stearic acid) or a metal salt thereof (e.g. titanium salts aluminum salt or iron salt) or a titanium coupling agent.

The hydrophobic silica and hydrophobic titanium preferably have a hydrophobicity index HI of at least 30, more preferably at least 40. The hydrophobicity index HI is defined as follows:

Sample (0.2 g) is added in a vessel containing 50 ml of water. Methanol is added dropwise until all of the sample sink. From the minimum amount (Wx) of the methanol required for precipitate the sample, the hydrophobicity index HI is determined according to the following equation:

$$HI=Wx/(50+Wx)\times 100.$$

Each of the hydrophobic silica and titanium oxide preferably has a volume average particle diameter of 0.01–4 $\mu$m, more preferably 0.02–0.8 $\mu$m. It is preferred that the hydrophobic silica be used in an amount of 0.05–2% by weight, more preferably 0.1–1.0% by weight based on the weight of the toner particles. It is also preferred that the weight ratio of the. hydrophobic silica to the titanium oxide be 10:1 to 1:10.

It is preferred that two, first and second types of binder resins which are incompatible with each other be used for forming the toner particles. By this expedient, expansion or dispersion of toner images and formation of "worm-eaten" portions can be minimized. Although not wishing to be bound by the theory, the mechanism of the prevention of the missing, expansion or dispersion of toner image attained by the use of two or more incompatible binder resins may be as follows. When such incompatible binder resins are used, there are formed first regions having relatively higher static chargeability and second regions having relatively lower static chargeability, with the first and second regions being dispersed in each toner particle. Because of the interaction between the first and second regions of different toner particles, undesirable scattering or missing of the toner particles is prevented. In an alternative, difference in electrical conductivity between the first and second regions may account for the improved property. Electric lines of force formed by the image transfer electric field are not distorted so that undesirable scattering or missing of the toner particles is prevented.

Any combination of incompatible binder resins may be used. Examples of suitable combination include a combination of a styrene-acrylic copolymer with at least one member selected from polyesters, epoxy resins and polyol resins. The polyol resins are products obtained by reacting (1) a mixture of (a) an epoxy resin, (b) a bisphenol and (c) a compound having an active hydrogen capable of reacting with the epoxy resin, or (2) a mixture of (a) an epoxy resin, (b) a bisphenol, (c) a compound having an active hydrogen capable of reacting with the epoxy resin and (d) an addition product of a bisphenol with an alkylene oxide or a diglycidyl ether of such an addition product and are disclosed in in JP-A-7-77832.

The epoxy resin (a) may be a diglycidyl ether of bisphenol A or bisphenol F and is preferably a mixture of relatively low (360–2,000) and relatively high (3,000–10,000) number average molecular weight diglycidyl ethers of a bisphenol. The bisphenol (b) may be bisphenol A or bisphenol C. The compound (c) may be a phenol compound such as phenol, aminophenol or an alkylphenol, e.g. cresol, isopropylphenol, nonylphenol, dodecylphenol, xylenol or p-cumylphenol. The diglycidyl ether of an additionproduct of a bisphenol with an alkylene oxide (d) is preferably a compound represented by the formula:

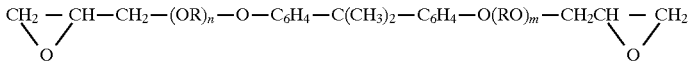

wherein R is an ethylene group, a propylene group or a trimethylene group and n and m are integers of 1 or more with the proviso that m+n is 2–8.

The toner of the present invention may be suitably used as a single-component-type development system. If desired, the toner may be used as a two-component-type developing system in conjunction with carrier particles which may be (a) magnetic particles such as of metals, compounds and alloys of iron, cobalt and nickel, e.g. ferrite, (b) glass beads or (c) composite particles composed of the above magnetic particles or glass beads each coated with a layer of a resin such as polyfluorocarbon, polyvinyl chloride, polyvinylidene chloride, a phenol resin polyvinyl acetal or a silicone resin. The weight ratio of the carrier particles to the toner particles is generally 1000:5 to 100:6.

The following examples will further illustrate the present invention. Parts are by weight.

| Preparation of Carrier A | |
|---|---|
| Silicone resin (KR50 manufactured by Shinetsu Silicone Inc.) | 100 parts |
| Toluene | 100 parts |

The above composition was mixed with a mixer for 30 minutes to form a dispersion. The dispersion was charged into a fluidized bed-type coating device together with 1,000 parts of ferrite particles having an average particle diameter of 50 $\mu$m. The ferrite particles thus coated were dried to obtain Carrier A.

Preparation of Hydrophobic Titanium Oxide

Titanium oxide particles (M-150 manufactured by Teika Inc.) were heated at 110° C. for 4 hours. The dried titanium oxide (10 g) was placed in a three-necked flask, to which 300 ml of dry toluene, 3 g of isobutyltrimethoxysilane (SS1120 manufactured by Toray Dow Corning Inc.) and 1 g of acetic acid were added. The mixture was then heated at 60° C. for 5 hours. After being allowed to be cooled to room temperature, the reaction mixture was filtered, washed with toluene and with ethanol and then dried to obtain white powder. This was pulverized in mortar and ground with a jet mill to obtain hydrophobic titanium oxide.

EXAMPLE 1

| Preparation of Magenta Toner Composition | |
|---|---|
| Water | 100 parts |
| Pigment Red 57 (water-containing cake, solid content: 50%) | 1,600 parts |

The above composition was stirred with a flasher and mixed with 1,000 parts of a polyester resin (acid value: 5, hydroxyl group value: 28, number average molecular weight Mn: 4,750, Mw/Mn: 4.5 (Mw: weight average molecular weight), glass transition point Tg: 63° C.) at 150° C. for 30 minutes. The resulting mixture was further mixed with 1,000 parts of xylene for 1 hour. The water and xylene were then removed and the residue was rolled, cooled and pulverized to obtain a master batch pigment.

| | |
|---|---|
| Styrene-n-butyl acrylate copolymer (molar ratio: 7/3, softening point: 106° C.) | 70 parts |
| Polyester resin (acid value: 5, hydroxyl group value: 27, Mn: 4,450, Mw/Mn: 4.2, Tg: 61° C. | 24 parts |
| Master batch pigment | 10 parts |
| Zinc salicylate (Bontron E84 manufactured by Orient Chemical Inc.) | 4 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.6% by weight of hydrophobic silica (H2000 manufactured by Hoechst Inc.) to obtain a magenta toner composition. The toner composition was found to have electric potential change ΔVp of 80 V and static charging ΔVs of 12 V. In the measurement of static charging ΔVs in this and other examples, an aluminum plate having a layer obtained by coating a solution, in tetrahydrofuran, of 1:1 by weight mixture of a hydrazone compound of the formula shown below with a polycarbonate resin was-used as an image carrier.

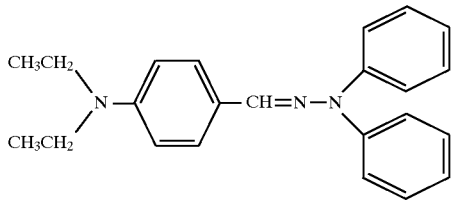

| Preparation of Cyan Toner Composition | |
|---|---|
| Water | 1,000 parts |
| Pigment Blue 15:3 (water-containing cake, solid content: 50%) | 1,600 parts |

The above composition was stirred with a flasher and mixed with 1,000 parts of a polyester resin (acid value: 5, hydroxyl group value: 28, Mn: 4,750, Mw/Mn: 4.5, Tg: 63° C. at 150° C. for 30 minutes. The resulting mixture was further mixed with 1,000 parts of xylene for 1 hour. The water and xylene were then removed and the residue was rolled, cooled and pulverized to obtain a master batch pigment.

| | |
|---|---|
| Styrene-n-butyl acrylate copolymer (molar ratio: 7/3, softening point: 106° C.) | 70 parts |
| Polyester resin (acid value: 5, hydroxyl group value: 27, Mn: 4,450, Mw/Mn: 4.2, Tg: 61° C.) | 24 parts |
| Master batch pigment | 10 parts |
| Zinc salicylate (Bontron E84 manufactured by Orient Chemical Inc.) | 4 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.6% by weight of hydrophobic silica (H2000 manufactured by Hoechst Inc.) to obtain a cyan toner composition. The toner composition was found to have electric potential change ΔVp of 80 V and static charging ΔVs of 15 V.

The carrier A (400 g) and each of the thus obtained toner compositions (20 g) were mixed with a ball mill for 30 minutes to obtain magenta and cyan developers. The developers were charged in respective developing sections of a color copying machine (PRETER 500 manufactured by Ricoh Company Ltd.). Copies produced by the copying machine were checked to evaluate the letter image quality. Clear high quality letter images without toner dispersion were obtained.

EXAMPLE 2

| Preparation of Magenta Toner Composition | |
|---|---|
| Polyester resin (acid value: 3, hydroxyl group value: 25, Mn: 4,500, Mw/Mn: 4.0, Tg: 60° C.) | 94 parts |
| Master batch pigment of Example 1 | 10 parts |
| Zinc salicylate (Bontron E84 manufactured by Orient Chemical Inc.) | 2 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.5% by weight of hydrophobic silica (R972 manufactured by Japan Aerosil Inc.) to obtain a magenta toner composition. The toner composition was found to have electric potential change ΔVp of 120 V and static charging ΔVs of 23.

| Preparation of Cyan Toner Composition | |
|---|---|
| Polyester resin (acid value: 3, hydroxyl group value: 25, Mn: 4,500, Mw/Mn: 4.0, Tg: 60° C.) | 97 parts |
| Master batch pigment of Example 1 | 5 parts |
| Zinc salicylate (Bontron E84 manufactured by Orient Chemical Inc.) | 2 parts |

The above composition was mixed with a mixer and melt-kneaded with a two-roll mill. The kneaded product was rolled, cooled, ground and sieved to obtain toner particles, having a volume average diameter of 7.5 μm. The toner particles were then mixed with 0.5% by weight of hydrophobic silica (R972 manufactured by Japan Aerosil Inc.) to obtain a cyan toner composition. The toner composition was found to have electric potential change ΔVp of 120 V and static charging ΔVs of 25 V.

Using these toner compositions, copy tests were performed using the PRETER copying machine in the same manner as that in Example 1. Clear letter images were obtained though very slight toner image dispersion was observed.

EXAMPLE 3

| Preparation of Black Toner Composition | |
|---|---|
| Water | 1,200 parts |
| Phthalocyanine Green (water-containing cake, solid content: 30%) | 200 parts |
| Carbon back (MA60 manufactured by Mitsubishi Chemical Inc.) | 540 parts |

The above composition was stirred with a flasher and mixed with 1,200 parts of a polyester resin (acid value: 3, hydroxyl group value: 25, Mn: 4,500, Mw/Mn: 4.0, Tg: 60° C.) at 150° C. for 30 minutes. The resulting mixture was further mixed with 1,000 parts of xylene for 1 hour. The water and xylene were then removed and the residue was rolled, cooled and pulverized to obtain a master batch pigment.

| | |
|---|---|
| Polyester resin (acid value: 3, hydroxyl group value: 25, Mn: 4,500, Mw/Mn: 4.0, Tg: 60° C.) | 100 parts |
| Above master batch pigment | 8 parts |
| Zinc salicylate (Bontron E84 manufactured by Orient Chemical Inc.) | 2 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.8% by weight of hydrophobic silica (R972 manufactured by Japan Aerosil Inc.) and 0.2% by weight of titanium oxide (T-805 manufactured by Japan Aerosil Inc.) to obtain a black toner composition.

| Preparation of Yellow Toner Composition | |
|---|---|
| Water | 600 parts |
| Pigment Yellow 17 (water-containing cake, solid content: 50%) | 1,200 parts |

The above composition was stirred with a flasher and mixed with 1,200 parts of a polyester resin (acid value: 3, hydroxyl group value: 25, Mn: 4,500, Mw/Mn: 4.0, Tg: 60° C.) at 150° C. for 30 minutes. The resulting mixture was further mixed with 1,000 parts of xylene for 1 hour. The water and xylene were then removed and the residue was rolled, cooled, pulverized and passed twice through a three-roll mill to obtain a master batch pigment.

| | |
|---|---|
| Polyester resin (acid value: 3, hydroxyl group value: 25, Mn: 4,500, Mw/Mn: 4.0, | 100 parts |

-continued

| | |
|---|---|
| Tg: 60° C.) | |
| Above master batch pigment | 8 parts |
| Zinc salicylate (Bontron E84 manufactured by Orient Chemical Inc.) | 2 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.8% by weight of hydrophobic silica (R972 manufactured by Japan Aerosil Inc.) and 0.2% by weight of titanium oxide (T-805 manufactured by Japan Aerosil Inc.) to obtain a yellow toner composition.

| Preparation of Magenta Toner Composition | |
|---|---|
| Water | 600 parts |
| Pigment Red 57 (water-containing cake, solid content: 50%) | 1,200 parts |

The above composition was stirred with a flasher and mixed with 1,200 parts of a polyester resin (acid value: 3, hydroxyl group value: 25, Mn: 4,500, Mw/Mn: 4.0, Tg: 60° C.) at 150° C. for 30 minutes. The resulting mixture was further mixed with 1,000 parts of xylene for 1 hour. The water and xylene were then removed and the residue was rolled, cooled, pulverized and passed twice through a three-roll mill to obtain a master batch pigment.

| | |
|---|---|
| Polyester resin (acid value: 3, hydroxyl group value: 25, Mn: 4,500, Mw/Mn: 4.0, Tg: 60° C.) | 100 parts |
| Above master batch pigment | 8 parts |
| Zinc salicylate (Bontron E84 manufactured by Orient Chemical Inc.) | 2 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.8% by weight of hydrophobic silica (R972 manufactured by Japan Aerosil Inc.) and 0.2% by weight of titanium oxide (T-805 manufactured by Japan Aerosil Inc.) to obtain a magenta toner composition.

| Preparation of Cyan Toner Composition | |
|---|---|
| Water | 600 parts |
| Pigment Blue 15:3 (water-containing cake, solid content: 50%) | 1,200 parts |

The above composition was stirred with a flasher and mixed with 1,200 parts of a polyester resin (acid value: 3, hydroxyl group value: 25, Mn: 4,500, Mw/Mn: 4.0, Tg: 60° C.) at 150° C. for 30 minutes. The resulting mixture was further mixed with 1,000 parts of xylene for 1 hour. The water and xylene were then removed and the residue was rolled cooled, pulverized and passed twice through a three-roll mill to obtain a master batch pigment.

| | |
|---|---|
| Polyester resin (acid value: 3, hydroxyl group value: 25, Mn: 4,500, Mw/Mn: 4.0, | 100 parts |

-continued

| | |
|---|---|
| Tg: 60° C.) | |
| Above master batch pigment | 5 parts |
| Zinc salicylate (Bontron E84 manufactured by Orient Chemical Inc.) | 2 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.8% by weight of hydrophobic silica (R972 manufactured by Japan Aerosil Inc.) and 0.2% by weight of titanium oxide (T-805 manufactured by Japan Aerosil Inc.) to obtain a cyan toner composition.

The carrier A (400 g) and each of the thus obtained toner compositions (20 g) were mixed with a ball mill for 30 minutes to obtain four kinds of developers. The developers were charged in respective developing sections of a color copying machine (PRETER 500 manufactured by Ricoh Company Ltd.). Copies produced by the copying machine were checked to evaluate the letter image quality. Clear high quality letter images without worm-eaten portions or toner dispersion were obtained.

EXAMPLE 4

Example 3 was repeated in the same manner as described except that 0.8% by weight of hydrophobic silica (R972) and 0.2% by weight of titanium oxide (T-805) were replaced by 0.4% by weight of hydrophobic silica (H2000 manufactured by Hoechst Inc.) and 0.6% by weight of hydrophobic titanium oxide (prepared as above), respectively. Clear high quality letter images without worm-eaten portions or toner dispersion were obtained.

EXAMPLE 5

Example 3 was repeated in the same manner as described except that 0.8% by weight of hydrophobic silica (R972) and 0.2% by weight of titanium oxide (T-805) were replaced by 0.08% by weight of hydrophobic silica (H2000 manufactured by Hoechst Inc.) and 0.4% by weight of titanium oxide (STT-30A manufactured by Titanium Industry Inc.), respectively. Clear letter images without toner dispersion were obtained, though very slight worm-eaten portions were observed.

EXAMPLE 6

Example 3 was repeated in the same manner as described except that 0.8% by weight of hydrophobic silica (R972) and 0.2% by weight of titanium oxide (T-805) were replaced by 1.2% by weight of hydrophobic silica (H2000/4 manufactured by Hoechst Inc.) and 0.1% by weight of titanium oxide (STT-30A manufactured by Titanium Industry Inc.), respectively. Clear letter images without worm-eaten portions were obtained, though very slight toner dispersion was observed.

EXAMPLE 7

Example 3 was repeated in the same manner as described except that 0.8% by weight of hydrophobic silica (R972) and 0.2% by weight of titanium oxide(T-805) were replaced by 0.8% by weight of hydrophobic silica (H2000 manufactured by Hoechst Inc.) and 0.2% by weight of titanium oxide (MT-500B manufactured by Teika Inc.), respectively. Clear letter images without toner dispersion were obtained, though very slight worm-eaten portions were observed.

EXAMPLE 8

Example 3 was repeated in the same manner as described except that 0.8% by weight of hydrophobic silica (R972) and 0.2% by weight of titanium oxide (T-805) were replaced by 1.0% by weight of hydrophobic silica (H2000 manufactured by Hoechst Inc.). Clear letter images without worm-eaten portions were obtained, though slight toner dispersion was observed.

EXAMPLE 9

Example 3 was repeated in the same manner as described except that 0.8% by weight of hydrophobic silica (R972) and 0.2% by weight of titanium oxide (T-805) were replaced by 0.3% by weight of hydrophobic silica (H2000 manufactured by Hoechst Inc.). Clear letter images without toner dispersion were obtained, though slight worm-eaten portions were observed.

EXAMPLE 10

Example 3 was repeated in the same manner as described except that 0.8% by weight of hydrophobic silica (R972) and 0.2% by weight of titanium oxide (T-805) were replaced by 0.6% by weight of titanium oxide (MT-500B manufactured by Teika Inc.). Clear letter images without toner dispersion were obtained, though slight worm-eaten portions were observed. The electric potential change of the toner compositions of Examples 3–10 were about 115 V.

EXAMPLE 11

| Preparation of Magenta Toner Composition | |
|---|---|
| Styrene-n-butyl acrylate copolymer (molar ratio: 7/3, softening point: 102° C.) | 35 parts |
| Epoxy resin (R304 manufactured by Mitsui Petrochemical Inc.) | 61 parts |
| Master batch pigment obtained in Example 1 | 10 parts |
| Zinc salicylate (Bontron E84 manufactured by Orient Chemical Inc.) | 2 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.5% by weight of hydrophobic silica (R972 manufactured by Japan Aerosil Inc.) to obtain a magenta toner composition. The toner composition was found to have electric potential change ΔVp of 90 V.

| Preparation of Cyan Toner Composition | |
|---|---|
| Styrene-n-butyl acrylate copolymer (molar ratio: 7/3, softening point: 102° C.) | 35 parts |
| Epoxy resin (R304 manufactured by Mitsui Petrochemical Inc. | 63 parts |
| Master batch pigment obtained in Example 1 | 5 parts |
| Zinc salicylate (Bontron E84 manufactured by Orient Chemical Inc.) | 2 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.5% by weight of hydrophobic silica (R972 manufactured by Japan Aerosil Inc.) to obtain a cyan toner composition. The toner composition was found to have electric potential change ΔVp of 90 V.

The carrier A (400 g) and each of the thus obtained toner compositions (20 g) were mixed with a ball mill for 30 minutes to obtain magenta and cyan developers. The developers were charged in respective developing sections of a color copying machine (PRETER 500 manufactured by Ricoh Company Ltd.). Copies produced by the copying machine were checked to evaluate the letter image quality. Clear high quality letter images without toner dispersion were obtained.

Comparative Example 1

| Preparation of Magenta Toner Composition | |
|---|---|
| Water | 1,000 parts |
| Pigment Red 57 (water-containing cake, solid content: 50%) | 1,600 parts |

The above composition was stirred with a flasher and mixed with 1,000 parts of a polyester resin (acid value: 25, hydroxyl group value: 45, Mn: 3,800, Mw/Mn: 6, Tg: 62° C.) at 150° C. for 30 minutes. The resulting mixture was further mixed with 1,000 parts of xylene for 1 hour. The water and xylene were then removed and the residue was rolled, cooled and pulverized to obtain a master batch pigment.

| | |
|---|---|
| Polyester resin (acid value: 25, hydroxyl group value: 45, Mn: 3,800, Mw/Mn: 6, Tg: 62° C.) | 24 parts |
| Master batch pigment | 10 parts |
| Zinc salicylate (Bontron E84 manufactured by Orient Chemical Inc.) | 4 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.8% by weight of hydrophobic silica (H2000 manufactured by Hoechst Inc.) to obtain a magenta toner composition. The toner composition was found to have electric potential change ΔVp of 160 V.

| Preparation of Cyan Toner Composition | |
|---|---|
| Water | 1,000 parts |
| Pigment Blue 15:3 (water-containing cake, solid content: 50%) | 1,600 parts |

The above composition was stirred with a flasher and mixed with 1,000 parts of a polyester resin (acid value: 25, hydroxyl group value: 45, Mn: 3,800, Mw/Mn: 6, Tg: 62° C.) at 150° C. for 30 minutes. The resulting mixture was further mixed with 1,000 parts of xylene for 1 hour. The water and xylene were then or removed and the residue was rolled, cooled and pulverized to obtain a master batch pigment.

| | |
|---|---|
| Polyester resin (acid value: 25, hydroxyl group value: 45, Mn: 3,800, Mw/Mn: 6, Tg: 62° C.) | 24 parts |
| Master batch pigment | 10 parts |
| Zinc salicylate (Bontron E84 manufactured by Orient Chemical Inc.) | 4 parts |

The above composition was mixed with a mixer and melt-kneaded with a two-roll mill. The kneaded product was rolled, cooled, ground and sieved to obtain toner particles having a volume average diameter of 7.5 μm. The toner particles were then mixed with 0.8% by weight of hydrophobic silica (H2000 manufactured by Hoechst Inc.) to obtain a magenta toner composition. The toner composition was found to have electric potential change ΔVp of 160 V.

The carrier A (400 g) and each of the thus obtained toner compositions (20 g) were mixed with a ball mill for 30 minutes to obtain magenta and cyan developers. The developers were charged in respective developing sections of a color copying machine (PRETER 500 manufactured by Ricoh Company Ltd.). Copies produced by the copying machine were checked to evaluate the letter image quality. Fine portions of the letter images were illegible due to toner dispersion, although no worm-eaten portions were observed.

Comparative Example 2

Comparative Example 1 was repeated in the same manner as described except that the amount of the hydrophobic silica was reduced to 0.3% by weight. Each of the magenta and cyan toner compositions was found to have electric potential change ΔVp of 160 V.

The carrier A (400 g) and each of the thus obtained toner compositions (20 g) were mixed with a ball mill for 30 minutes to obtain magenta and cyan developers. The developers were charged in respective developing sections of a color copying machine (PRETER 500 manufactured by Ricoh Company Ltd.). Copies produced by the copying machine were checked to evaluate the letter image quality. Significant worm-eaten portions were observed although the degree of toner dispersion was small.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An image forming method wherein a toner image on an image carrier is transferred to an intermediate image transfer element, the transferred toner image on said intermediate image transfer element being subsequently transferred to a transfer medium, and wherein said toner exhibits an electric potential change ΔVp of less than 120 V as an absolute value in the charge penetration test defined in the Specification.

2. A toner composition for developing an electrostatic image, which exhibits an electric potential change ΔVp of less than 120 V as an absolute value in the charge penetration test defined in the Specification.

3. A toner composition as claimed in claim 2, wherein said electric potential change ΔVp is less than 100 V as an absolute value.

4. A toner composition as claimed in claim 2, which exhibits static charging ΔVs of less than 20 V as an absolute value in the frictional charging test defined in the Specification.

5. A toner composition as claimed in claim 2, comprising toner particles each including a binder resin and a colorant, and a mixture of hydrophobic silica particles with titanium oxide particles.

6. A toner composition as claimed in claim 5, wherein said titanium oxide particles are hydrophobic.

7. A toner composition as claimed in claim 5, wherein said hydrophobic silica particles are present in an amount of 0.1–1.0% by weight based on the weight of said toner particles and wherein the weight ratio of said hydrophobic silica particles to said titanium oxide particles is in the range of 1:10 to 10:1.

8. A toner composition as claimed in claim 2, comprising toner particles each including a colorant and two, first and second types of binder resins which are incompatible with each other.

9. A toner composition as claimed in claim 8, wherein said first type of binder resin is a styrene-acrylate copolymer and said second type of binder resin is at least one member selected from the group consisting of polyesters, epoxy resins, polyol resins and mixtures thereof.

* * * * *